US005679935A

United States Patent [19]

Baba et al.

[11] Patent Number: 5,679,935

[45] Date of Patent: Oct. 21, 1997

[54] CHANGE-OVER SWITCH

[75] Inventors: Hidekazu Baba; Keisaku Zenmei; Shuzo Isozumi, all of Hyogo, Japan

[73] Assignee: Mitsubishi Denki Kabushiki Kaisha, Tokyo, Japan

[21] Appl. No.: 499,775

[22] Filed: Jul. 6, 1995

[30] Foreign Application Priority Data

Dec. 13, 1994 [JP] Japan ..... 6-308798

[51] Int. Cl.[6] ..... H01H 67/02

[52] U.S. Cl. ..... 200/17 R; 335/126

[58] Field of Search ..... 200/17 R; 335/78–86, 335/106, 107, 121, 124, 126, 127, 185–204

[56] References Cited

U.S. PATENT DOCUMENTS

| | | | |
|---|---|---|---|
| 2,535,556 | 12/1950 | Tyrner | 200/87 |
| 2,892,058 | 6/1959 | Tancred | 200/104 |
| 2,919,324 | 12/1959 | Schuessler | 200/93 |
| 3,505,625 | 4/1970 | Nielsen et al. | 335/132 |
| 4,644,179 | 2/1987 | Pointout et al. | 307/10 BP |
| 5,394,128 | 2/1995 | Perreira et al. | 335/126 |

FOREIGN PATENT DOCUMENTS

| | | | |
|---|---|---|---|
| 1615793 | 9/1967 | Germany | H01H 50/54 |
| 1914384 | 10/1969 | Germany | H01H 50/20 |
| 2750754 | 5/1978 | Germany | H01H 50/20 |
| 2-24195 | 7/1990 | Japan | H01H 50/54 |

*Primary Examiner*—Michael L. Gellner
*Assistant Examiner*—Michael A. Friedhofer
*Attorney, Agent, or Firm*—Sughrue, Mion, Zinn, Macpeak, and Seas

[57] ABSTRACT

A moving contact assembly to which a moving contact is fitted so as to allow a normally open common fixed contact part to elude the moving contact and axially pass through is mounted detachably on a fixed core. A contact mold having a normally closed fixed contact part and a cap switch provided with a normally open fixed contact part, a normally closed common fixed contact part, and a normally open common fixed contact part are made axially separable. The contact mold is turned 90 degrees in one direction to allow the normally open common fixed contact part to elude the moving contact and axially pass through. Thus, when the contact mold is turned 90 degrees in the other direction to the contact mold's former condition, the moving contact can be positioned within a recessed groove of a common fixed contact.

12 Claims, 5 Drawing Sheets

CHANGE-OVER SWITCH

BACKGROUND OF THE INVENTION

This invention relates to an improvement on a change-over switch having first and second fixed contacts spaced along the movable direction of a move shaft member to which a moving contact is fitted, driven axially by means of a moving core.

For example, a conventional change-over switch is as shown in FIG. 10 disclosed in Japanese Utility Model Publication No. Hei 2-24195. FIG. 10 is a longitudinal sectional view showing the axial section of the change-over switch; since the change-over switch shown is vertically symmetrical with respect to the center, the sectional view of the upper half of the switch is shown. Such a change-over switch is, for example, fitted to a vehicle and is used to supply an output of a generator to a heater of an electrically heated catalyst carrier (EHC) after an engine is started and divert the generator output from the heater to battery charge which is the normal operation performed after the heating is completed; the electric power is about thirty-odd volts, 100 amperes, for example.

In FIG. 10, numeral 1 is the change-over switch and numeral 2 is a solenoid valve which comprises a cylindrical yoke 3 made of a soft steel member, a fixed core 4 crimped to an in low part 3*a* disposed on the end of the yoke, an excitation coil 5 wound around the inside of the yoke 3, and a moving core 6 which moves to the right in the figure and is attracted so as to abut against the end face of a protrusion part 4*a* of the fixed core by an excitation force when the excitation coil 5 is energized.

Numeral 7 is a moving shaft which is provided with a step process part 7*a* having a somewhat small diameter in the right part in the figure and ring recessed grooves 7*b* and 7*c* cut near at the center and the right end. The moving shaft 7 is fitted into the rear end of the moving core 6. Numeral 8 is a coil spring which is secured in a compressed condition between a recessed groove 4*b* cut on the inner peripheral surface at the center of the protrusion 4*a* of the fixed core 4 and the moving core 6, giving return energy to the moving core 6.

Numeral 9 is a cap assembly which consists of a cap 10 divided into a left part 10*a* and a right part 10*b* made of resin mold material and fixed contacts 11 and 12 secured to the caps 10*a* and 10*b* and is threadably attached to the right end face of the solenoid 2 with a screw (not shown).

Numeral 13 is a disk-like moving contact which is placed axially movably on an insulation bush 14 loosely fitted on the moving shaft 7. Numeral 15 is a coil spring which is inserted in a compressed condition between the step process part 7*a* of the moving shaft 7 and the insulation bush 14. Numeral 16 is a retaining ring which engages the recessed part 7*b* of the moving shaft 7 and receives pressure of the spring 15 via the insulation bush 14, regulating a right move of the insulation bush 14. Numeral 17 is a cup which is made of a flexible member, such as resin mold material, and is loosely fitted on the moving shaft 7 slidably from side to side in the figure. Numeral 18 is a coil spring. Numeral 19 is a retaining ring which engages the recessed part 7*c* provided at the right end of the moving shaft 7. The coil spring 18 is placed between the cup 17 and the retaining ring 19 in a compressed condition, pressing the moving contact 13 against the fixed contact 11 via the cup 17.

The change-over switch is assembled as follows:

The coil spring 8 is placed on the moving shaft 7 into which the moving core 6 is fitted and is inserted into the recessed groove 4*b* of the fixed core from the left of the figure for protruding the right part of the moving shaft 7 from the fixed core 4. Next, the spring 15 and the insulation bush 14 are inserted into the step process part 7*a* of the moving shaft 7 and with the spring 15 compressed a predetermined dimension, the retaining ring 16 is engaged into the recessed groove 7*b*.

Subsequently, the left part 10*a* of the cap 10 is placed. Next, the moving contact 13 is fitted to the insulation bush 14 and further the cup 17, the coil spring 18, and the retaining ring 19 are inserted into the moving shaft 7 in order. Finally, the right part 10*b* of the cap 10 is placed and the cap parts 10*a* and 10*b* are fixed to the right end face of the solenoid 2 with a screw (not shown).

Next, the operation will be discussed. When the excitation coil 5 is energized, the moving core 6 is attracted to the protrusion 4*a* of the fixed core 4, so that the moving shaft 7 is driven right, causing the moving contact 13 to abut against the fixed contact 12. The moving contact 13 abuts the fixed contact 12, when the moving core 6 and the moving shaft 7 are moved to the right by dimension X (shown in FIG. 10), thereby applying the pressure of the spring 15 to the moving contact 13 via the insulation bush 14 so that the moving contact 13 abuts against the fixed contact 12.

When the excitation coil 5 is unenergized and its attraction is lost, return energy of the coil spring 8 causes the moving core 6 and the moving shaft 7 to slide to the left of the figure and return to the origin. At the same time, the 13 is also caused to abut the fixed contact 11. When the moving contact 13 is pressed via the cup 17 by the coil spring 18, so that a necessary contact abutment force is provided between the moving contact 13 and the fixed contact 11.

Since the conventional change-over switch has the above-mentioned structure, its assembly is not easy to perform and requires a large number of steps. That is, for assembly, first the spring 15, the insulation bush 14, and the retaining ring 17 are fitted to the moving shaft 7, next the left part 10*a* of the cap 10 axially detachable is placed, further the moving contact 13, the cup 17, the coil spring 18, and the retaining ring 19 are fitted to the moving shaft 7, and finally the left part 10*b* of the cap 10 is placed. However, these steps must be performed in a condition in which the moving shaft 7 to which the moving core 6 is fitted is built in the solenoid valve.

SUMMARY OF THE INVENTION

It is therefore an object of the invention to provide an inexpensive change-over switch whose moving contacts can be easily assembled, and an inexpensive change-over switch which can be easily assembled and enables the number of parts to be reduced.

According to the invention, there is provided a change-over switch comprising an electro-magnetic coil device having a fixed core, an excitation coil, and a moving core axially driven by energy of the excitation coil, a moving contact assembly having a moving shaft member axially driven by the moving core and a moving contact fitted to the moving shaft member, and a fixed contact assembly having a support member for supporting a first set of fixed contacts and a second set of fixed contacts spaced from the first fixed contact set at a predetermined distance in a direction in which the moving shaft member is driven, the fixed contact assembly being fixed to the electro-magnetic coil device so that when the excitation coil is not energized, the moving contact is pressed into contact with the first fixed contact set and when the excitation coil is energized, the moving contact is pressed into contact with the second fixed contact set, wherein the, moving contact assembly is supported by the electro-magnetic coil device so that it is detachable from the fixed contact side and driven when the moving shaft member abuts the moving core.

The moving contact assembly can be attached to and detached from the electro-magnetic coil device, thus the moving contact assembly with the moving contact member previously fitted to the moving shaft member can be fitted to the electro-magnetic coil device. Therefore, the moving contact assembly can be easily assembled and the number of assembly steps can also be reduced.

In the change-over switch according to the invention, the fixed contact assembly comprises a first fixed contact assembly having a first support member for supporting the first fixed contacts and a second fixed contact assembly having a second support member for supporting the second fixed contacts, the second fixed contact assembly being able to be separated axially from the first fixed contact assembly.

The first and second fixed contact assemblies are made axially separable, thus the moving contact assembly can be fitted to the electro-magnetic coil device so as to put the moving contact assembly between the first and second fixed contact assemblies. Therefore, the moving contact assembly can be furthermore easily assembled and the number of assembly steps can also be reduced.

In the change-over switch according to the invention, the first support member is a first hollow insulation support member integrally molded with the first fixed contacts with insulation material and the second support member is a second insulation support member integrally molded with the second fixed contacts with insulation material, the second insulation support member is fixed to the electro-magnetic coil device with the first insulation support member between, and the moving contact is housed in a substantially airtight housing part defined by the second insulation support member, the first insulation support member, and the electro-magnetic coil device.

When the moving contact is housed in the substantially airtight housing part defined by the second insulation support member, the first insulation support member, and the electro-magnetic coil device, likewise the moving contact assembly can be fitted to the electro-magnetic coil device so as to put the moving contact assembly between the first and second insulation support members; assembly is furthermore facilitated. Since the first or second insulation support member integrally molded supports the first or second fixed contact, the fixed contacts can be easily supported and the number of assembly steps can be reduced. Also, the moving contact is housed in the housing part for protection.

In the change-over switch according to the invention, the fixed contact assembly comprises a first fixed contact assembly having a first support member for supporting at least one of the first fixed contacts, a second fixed contact assembly having a second support member for supporting at least one of the second fixed contacts, the second fixed contact assembly being able to be separated axially from the first fixed contact assembly, and a common fixed contact having a groove recessed from the diametric inside toward the outside with one of the first fixed contacts and one of the second fixed contacts molded in one piece, the common fixed contact being supported by the first or second support member, the moving contact being positioned within the recessed groove allowing one of the first fixed contacts to elude the moving contact and axially pass through.

The first and second support members are made axially separable. For example, the first or second support member and the moving contact assembly are previously combined so that the moving contact is positioned within the recessed groove of the common fixed contact supported by the first or second support member, and then fixed to the electro-magnetic coil device, whereby one of the first fixed contacts and one of the second fixed contacts can be made a common fixed contact without placing restriction on the form of the moving contact. Therefore, the common fixed contact enables the number of parts to be reduced and can be easily supported by the support member; assembly is furthermore facilitated and the number of assembly steps can be reduced.

In the change-over switch according to the invention, the first support member is a first insulation support member integrally molded with at least one of the first fixed contacts and common fixed contact with insulation material and the second support member is a second insulation support member integrally molded with at least one of the second fixed contacts and common fixed contact with insulation material, the second insulation support member is fixed to the electro-magnetic coil device with the first insulation support member between, and the moving contact is housed in a substantially airtight housing part defined by the second insulation support member, the first insulation support member, and the electro-magnetic coil device.

The moving contact can be positioned within the recessed groove of the common fixed contact, whereby one of the first fixed contacts and one of the second fixed contacts can be made a common fixed contact without placing restriction on the form of the moving contact.

Since the first or second insulation support member integrally molded supports the first or second fixed contact, the fixed contacts can be easily supported. Therefore, when the moving contact is housed in the substantially airtight housing part defined by the second insulation support member, the first insulation support member, and the electro-magnetic coil device, the number of parts can also be reduced, assembly is also facilitated, and the number of assembly steps can also be reduced. Also, the moving contact is housed in the housing part for protection.

In the change-over switch according to the invention, the moving contact is formed like a disk and is positioned within the recessed groove.

The disk-like moving contact eliminates the need for strict alignment of moving and fixed contacts, thus assembly is also easy to made and the manufacturing costs also become low.

In the change-over switch according to the invention, the moving contact is formed to allow one of the first fixed contacts to elude the moving contact and axially pass through.

The first or second fixed contact assembly or the moving contact can be rotated for positioning the moving contact within the recessed groove of the common fixed contact. Thus, if one of the first fixed contacts and one of the second fixed contacts are made a common fixed contact, assembly can be made from the axial direction, namely, from one direction; the assembly is highly flexible and the work time can also be reduced. The common fixed contact enables the number of parts to be reduced and can be easily supported by the support member.

In the change-over switch according to the invention, the fixed contact assembly has a common support member for supporting the first and second fixed contacts, the moving contact is formed to allow the first fixed contacts to elude the moving contact and axially pass through, and the common support member is fixed to the electro-magnetic coil device so that the moving contact is positioned between the first and second fixed contacts allowing the first fixed contacts to elude the moving contact and axially pass through.

The moving contact is formed to allow the first fixed contacts to elude the moving contact and axially pass through. Thus, after the first fixed contacts are allowed to elude the moving contact and axially pass through, the common support member or the moving contact can be rotated for assembling so that the moving contact is positioned between the first and second fixed contacts. Thus, the first and second fixed contacts can be supported by the common support member. Therefore, the common fixed contact enables the number of parts to be reduced; assembly is furthermore facilitated and the number of assembly steps can be reduced.

In the change-over switch according to the invention, the common support member is a hollow integral support member integrally molded with the first and second fixed contacts with insulation material, the integral support member is fixed to the electro-magnetic coil device so that the moving contact is positioned between the first and second fixed contacts allowing the first fixed contacts to elude the moving contact and axially pass through, and the moving contact is housed in a substantially airtight housing part defined by the integral support member and the electro-magnetic coil device.

After the first fixed contacts are allowed to elude the moving contact and pass through, the integral support member or the moving contact can be rotated so that the moving contact is positioned between the first and second fixed contacts. Since the first and second fixed contacts are supported by the integral support member, the fixed contacts can be easily supported. Therefore, when the moving contact is housed in the substantially airtight housing part defined by the integral support member and the electro-magnetic coil device, the number of parts can also be reduced, assembly is also facilitated, and the number of assembly steps can be reduced.

In the change-over switch according to the invention, the fixed contact assembly comprises a common fixed contact having a groove recessed from the diametric inside toward the outside with one of the first fixed contacts and one of the second fixed contacts molded in one piece, the moving contact being positioned within the recessed groove allowing one of the first fixed contacts to elude the moving contact and axially pass through.

One of the first fixed contacts and one of the second fixed contacts are molded in one piece to provide the common fixed contact. Therefore, the number of parts can further be reduced, assembly is furthermore facilitated, and the number of assembly steps can be reduced.

In the change-over switch according to the invention, the moving shaft member is supported by the electro-magnetic coil device so that it does not rotate.

The moving shaft member is supported by the electro-magnetic coil device so that it does not rotate. Thus, there is no chance that the moving shaft member, which ordinarily rotates due to vibration when in operation if it is not fixed, will make an insufficient area in which the moving contact can contact the first or second fixed contact. Similarly, there is no chance that the moving and fixed contacts will be placed out of contact with each other. Accordingly, reliability is improved.

DETAILED DESCRIPTION OF PREFERRED EMBODIMENTS

Referring now to the accompanying drawings, there are shown preferred embodiments of the invention.

Figure 1:
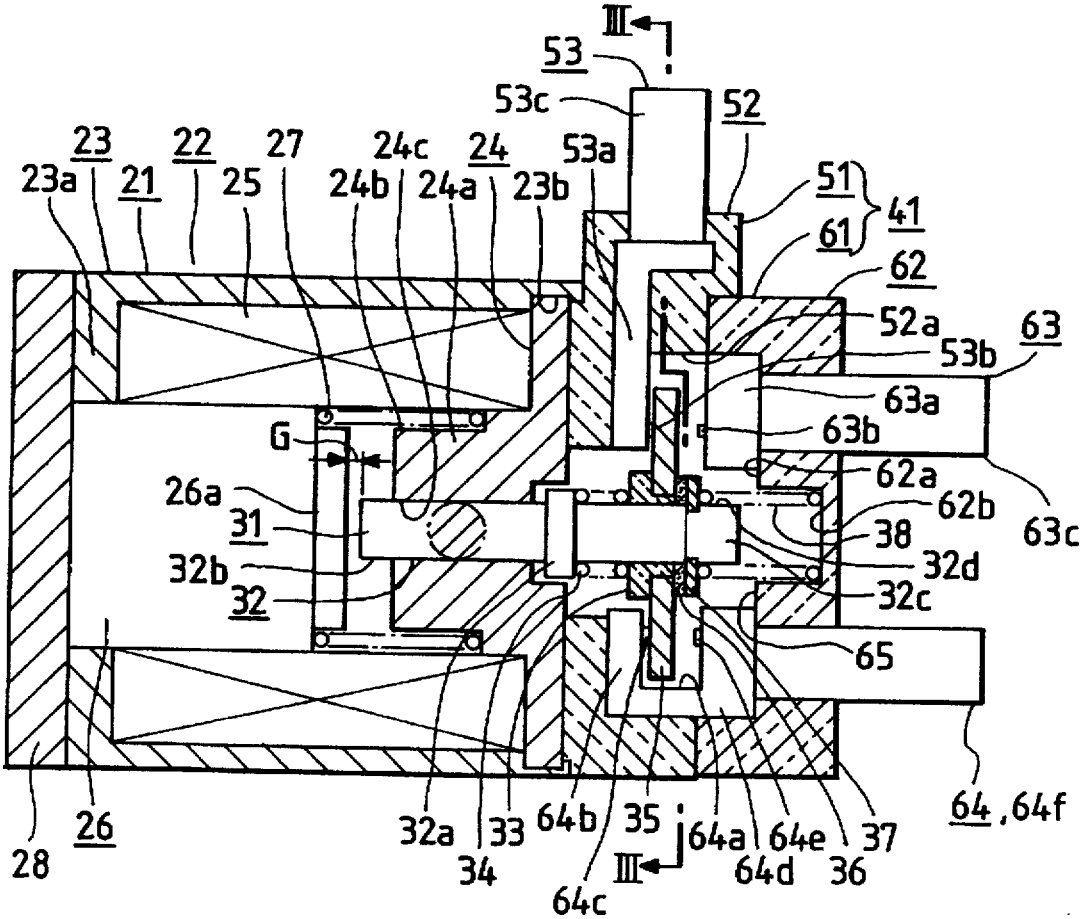
FIG. 1 is a longitudinal sectional view showing the axial section of a change-over switch according to one embodiment of the invention.
Figure 2:
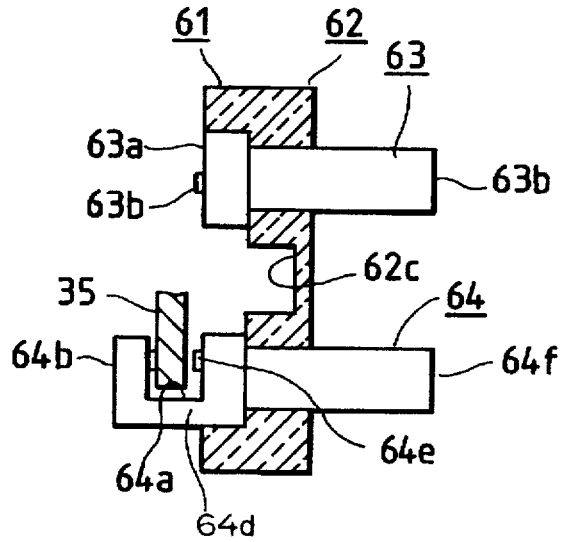
FIG. 2 is a drawing showing details of a cap switch in the embodiment FIG. 1.
Figure 3:
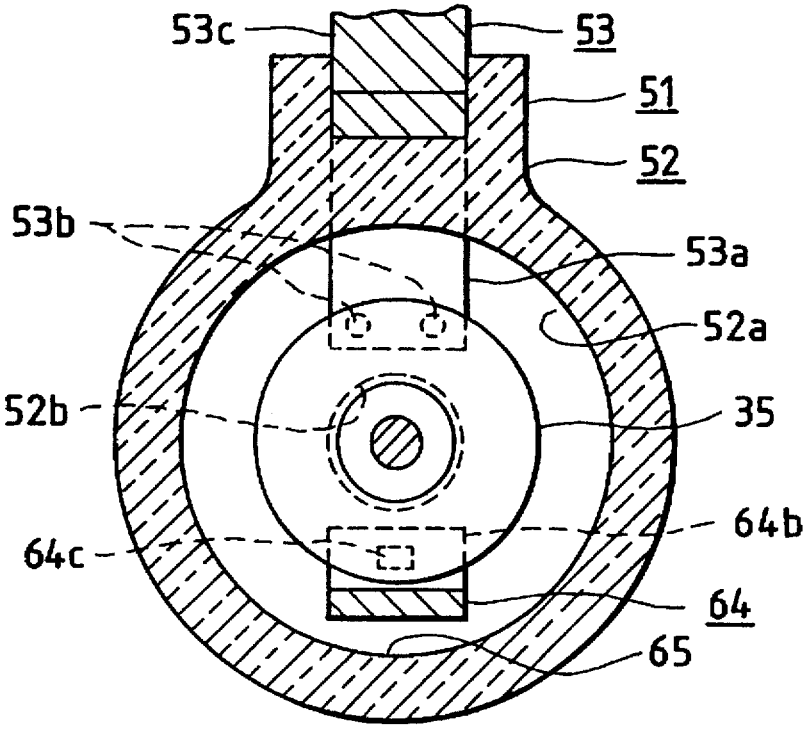
FIG. 3 is a sectional view taken on line III—III in FIG. 1.
Figure 4:
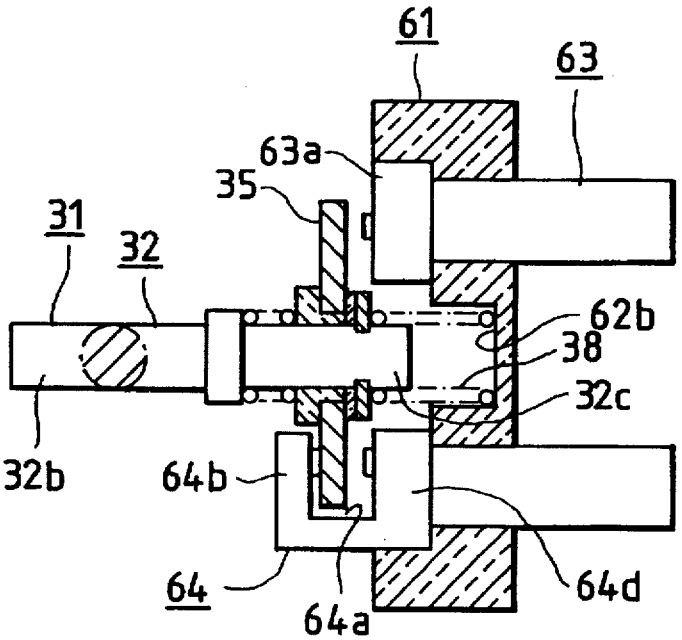
FIG. 4 is an illustration showing an assembly procedure in the embodiment in FIG. 1.

Embodiment 1:

FIG. 1 is a longitudinal sectional view showing the axial section of a change-over switch. FIG. 2 is a drawing showing details of a cap switch. FIG. 3 is a sectional view taken on line III—III in FIG. 1. FIG. 4 is an illustration showing an assembly procedure.

In the figures, a change-over switch 21 includes the following structure: An electro-magnetic coil device 22 has a yoke 23, a fixed core 24, an excitation coil 25, and a moving core 26. The yoke 23 has a perforated disk part **23*a* provided integrally in the left part of FIG. 1 like a hollow cylinder and is made of soft steel magnetic material. It comprises a fitting part 23*b* having a somewhat large inner diameter at its right end where the fixed core 24 is fitted and crimped. The fixed core 24 has a protrusion 24*a* protruded to the left of the figure at the center, a step part 24*b* having a slightly small diameter on the left of the protrusion, a circular through hole 24*c* punched at the center, and a counterbore 24*d*** counterbored like a circle on the right of the through hole.

The excitation coil 25 is wound around the inside of the yoke 23 like a cylinder. The moving core 26, which is like a hollow cylinder, has a small diameter part **26*a* having a small diameter in the right end part and is inserted into the excitation coil 25 movably from side to side of the figure as shown. A core return spring 27, which is wound like a coil and compressed, is inserted above the small diameter part 26*a* of the moving core and the step part 24*a* of the fixed core, giving return energy to the moving core 26 for returning it left. A cover 28, which is made of nonmagnetic material, is fixed to the left of the yoke 23 with a screw (not shown), covering the openings of the disk part 23*a* and regulating motion of the moving core 26**. The electro-magnetic coil device has the above-described structure.

The change-over switch 21 also includes a moving contact assembly 31 which has the structure described below. The moving contact assembly 31 includes a moving shaft member 32 comprises a flange part **32*a*, a left shaft part 32*b*, and a right shaft part 32*c* provided by machining steel material, each of which has a circular section. The right shaft part 32*c* is formed with a recessed groove 32*d* like an annular ring and the left shaft part 32b is inserted into the through hole 24c of the fixed core so as to be axially slidable. An insulation bush 33 is loosely fitted to the right shaft part 32c of the moving shaft member axially slidably. A contact pressure spring 34 is inserted between the flange part 32c of the moving shaft member and the insulation bush 33** in a compressed condition.

A moving contact 35 is made of a copper alloy like a disk and is fitted to the step of the insulation bush 33. An insulation disk 36 is inserted into the right shaft part 32c so as to put the moving contact 35 between it and the insulation bush 34 axially.

A retaining ring 37 is fitted into the recessed groove 32d of the right shaft part 32c and receives pressure of the moving contact pressure spring 34 via the insulation bush 33 and the insulation disk 36, regulating a right move of the insulation bush 33.

The moving contact assembly 31 has the structure and the above-described left shaft part 32b of the moving shaft member 32 is loosely fitted to the through hole 24c of the fixed core.

A moving shaft member return spring 38 is placed between the insulation disk 36 and a recess 62b of a second insulation support member (described below) in a compressed condition, and presses the moving shaft member 32 toward the left of the figure via the retaining ring 37 fitted to the recessed groove 32d of the right shaft part, giving return energy. As the moving shaft member returns to its normally closed position, the moving shaft member return spring 38 presses the moving contact 35 against a normally closed fixed contact part 53a and a normally closed common fixed contact part 64b. (described below) thereby creating pressure between the moving contact 35 and the contact parts 53a and 64b.

A predetermined gap G is provided between the left end of the moving shaft member 32 and the right end of the moving core 26. The gap G is provided to absorb a work dimension error and the abrasion of moving and fixed contacts during the operation of the change-over switch 21. When the moving shaft member 32 returns to the left, it abuts the fixed core 26. The leftward movement of the moving shaft 32 is regulated, however, so as to prevent the contact pressure between the moving contact 35 and the normally closed fixed contact part 53a and the normally closed common contact part 64b from becoming insufficient.

Next, a fixed contact assembly 41 will be discussed. The fixed contact assembly 41 consists of a contact mold 51, a first fixed contact assembly, and a cap switch 61, a second fixed contact assembly.

Further, the contact mold 51 has the following structure: A first mold member 52, which has a hollow form like a plate in the embodiment rather than like a cylinder, is formed with a first circular housing part 52a and a hole 52b through which the moving shaft member 34 passes at the center (see FIG. 3). The first mold member 52 is inserted and molded integrally with the normally closed fixed contact 53 (described below) with insulation mold material. The first mold member 52 is a first support member and also a first insulation support member in the invention.

The normally closed fixed contact 53, which is made of a copper alloy, has a sheet-like contact part 53a having an L-letter section, two circular protrusions 53b provided in the contact part, and a rod-like battery connection terminal 53c brazed to the contact part 53a.

The cap switch 61 has the following structure: A second mold member 62, which is formed like a dish, comprises a second circular housing part 62a and a recess 62b for housing the moving shaft member return spring 38 at the center of the second housing part 62a. The second mold member 62 is inserted and molded integrally with a normally open fixed contact 63 and a common fixed contact 64 (described below) with insulation mold material. The second mold member 62 is a second support member and also a second insulation support member in the invention.

The normally open fixed contact 63, which is made of a copper alloy, has a slab-like contact part 63a of a quadrangle, two circular protrusions 63b provided in the contact part, and a rod-like load connection terminal 63c brazed to the contact part 63a.

The common fixed contact 64 has a recessed groove 64a formed from the diametric inside toward the outside in a rectangular parallelopiped block made of a copper alloy and has an axial section formed as shown in FIG. 1. The left part of the common fixed contact 64 separated at the recessed groove 64a provides a normally closed common fixed contact part 64b where a protrusion 64c is formed. The right part of the common fixed contact 64 provides a normally open common fixed contact part 64d where a protrusion 64e is formed. A generator connection terminal 64f connected to a generator is brazed to the normally open common fixed contact part 64d.

The left end faces of the second mold 62, the normally open fixed contact part 63d, and the normally open common fixed contact part 64d are positioned within the same plane as shown in the figure and they are inserted and molded.

The cap switch 61 has the structure described above.

The normally closed fixed contact 53 and the normally closed common fixed contact part 64b of the common fixed contact inserted and molded to the cap 62 are a first pair of fixed contacts in the invention and the normally open fixed contact 63 and the normally open common fixed contact part 64d are a second pair of fixed contacts in the invention.

With the moving contact 35 positioned within the recessed groove 64a of the common fixed contact of the cap switch, packing (not shown) is inserted between the fixed core 24 and the contact mold 51 and between the contact mold 51 and the cap switch 61 and fixed to the fixed core 24 with a through bolt (not shown). Thus, the cap switch 61, the contact mold 51, and the fixed core 24 define a housing part 65 in substantial gas-sealing relation for housing the moving contact 35.

The change-over switch having the structure described above is assembled in the manner set forth below.

The electro-magnetic coil device 22 and the moving contact assembly 31 are previously assembled. That is, the contact pressure spring 34, the insulation bush 33, the moving contact 35, and the insulation disk 36 are inserted into the right shaft part 32c of the moving shaft member and the retaining ring 37 is fitted into the recessed groove 32d of the right shaft part for assembling the moving core assembly 31. At the same time, the contact pressure spring 34 is compressed by the flange part 32c of the moving shaft member 32 and the insulation bush 33.

Figure 10:
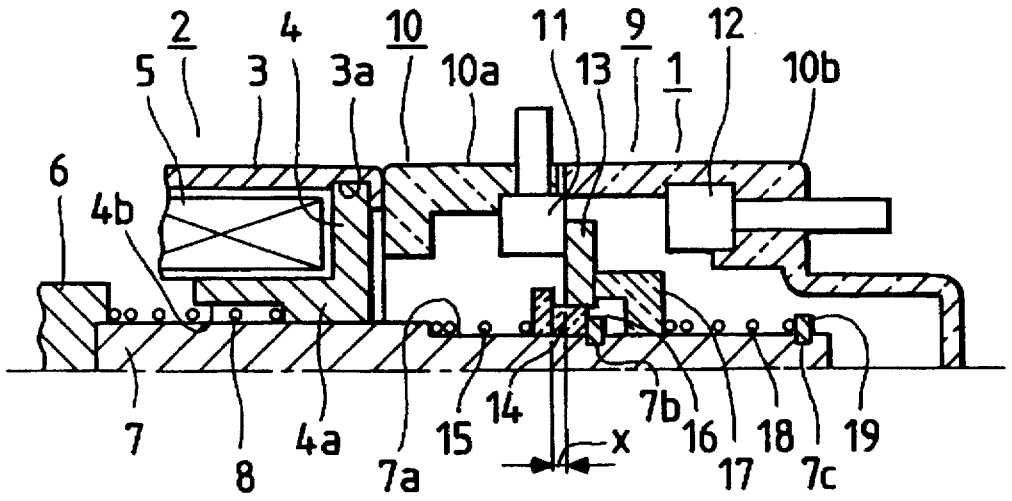
FIG. 10 is a longitudinal sectional view showing the axial section of a conventional change-over switch.

The preassembled electro-magnetic coil device 22 is placed with the fixed core 24 in FIG. 10 upward. The contact mold 51 is placed on the fixed core 24 by using the fitting part 23b of the yoke as a guide. Next, as shown in FIG. 4, the moving shaft member spring 38 is inserted into the right shaft part 32c of the moving shaft member 32 and the recess 62b of the cap switch and the moving core assembly 31 and the cap switch 61 are combined so that the disk-like moving contact 35 built in the moving core assembly 31 is positioned within the recessed groove 64a of the common fixed contact 64.

The assembly is placed with the cap switch 61 upward and the left shaft part 32*b* of the moving shaft member 32 is inserted into the through hole 24*c* of the fixed core from above the electro-magnetic coil device 22. After this, the contact mold 51 and the cap switch 61 are fixed integrally to the electro-magnetic coil device with a through bolt (not shown). Although no description is given, packing (not shown) is inserted between the fixed core 24 and the contact mold 51 and between the contact mold 51 and the cap switch 61 for placing the housing part 65 defined by the cap switch 61, the contact mold 51, and the fixed core 24 in substantial gas-sealing relation for protecting the moving contact 35 against water penetration and dust.

The operation of the change-over switch thus structured is similar to that of the conventional change-over switch shown in FIG. 10. Some supplemental remarks are given. When the excitation coil 25 is not energized, the moving shaft member 32 is pressed toward the left of FIG. 1 by the moving shaft member return spring 38 and the moving contact 35 is pressed by the protrusion 53*b* of the normally closed fixed contact part 53*a* and the protrusion 64*c* of the normally closed common fixed contact part 64*b* for conduction between them.

When the excitation coil 25 is energized, the moving core 26 is attracted to the fixed core 24 and moves to the right of the figure. The moving shaft member 32 abuts the right end of the moving core 26 and is driven right against, spring force of the moving shaft member return spring 38. The right side face of the moving contact 35 is pressed by the protrusion 63*b* of the normally open fixed contact part 63*a* and the protrusion 64*e* of the normally open common fixed contact part 64*d* for conduction between them.

After the moving contact 35 abuts the protrusion 63*b* of the normally open fixed contact part 63*a* and the protrusion 64*e* of the normally open common fixed contact part 64*d*, the moving shaft member 32 is still driven right until the moving core 26 abuts the fixed core 24 and stops. Thus, the contact pressure spring 34 is compressed via the insulation bush 33 sliding with the right shaft part 32*c* of the moving shaft member. This gives the required pressure between the moving contact 35 and the normally open fixed contact part 63*a* and the normally open common fixed contact part 64*d*.

Figure 5:
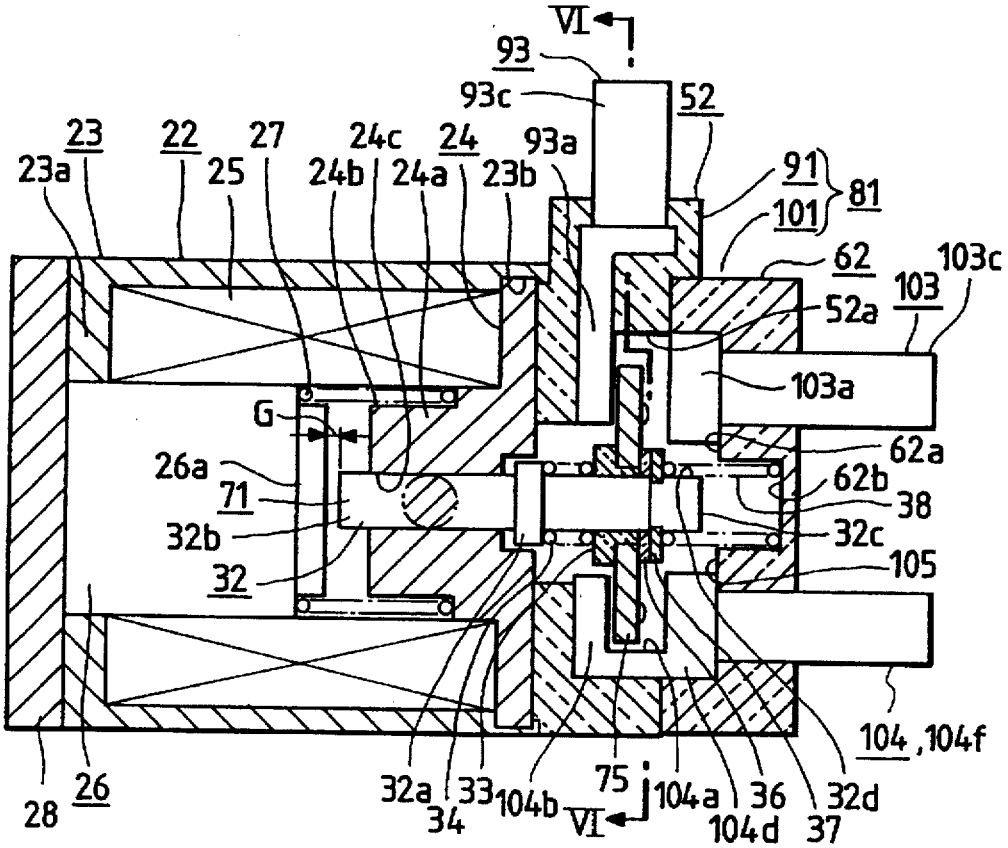
FIG. 5 is a longitudinal sectional view showing the axial section of a change-over switch according to another embodiment of the invention.
Figure 6:
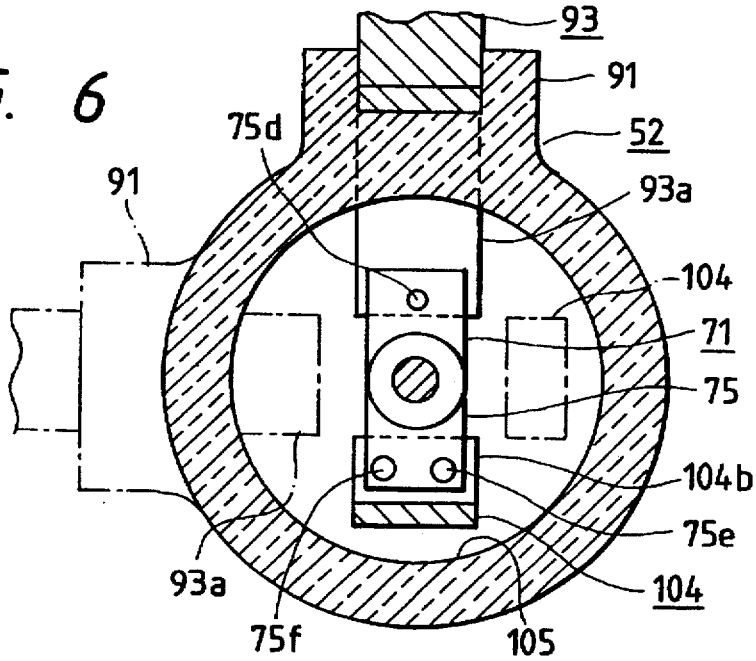
FIG. 6 is a sectional view taken on line VI—VI in FIG. 5.
Figure 7A:
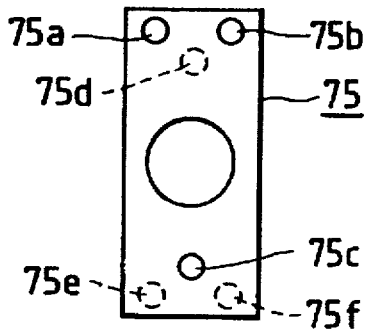
FIGS. 7(A) and 7(*b*) are drawings showing details of a moving contact in the embodiment in FIG. 5.
Figure 7B:
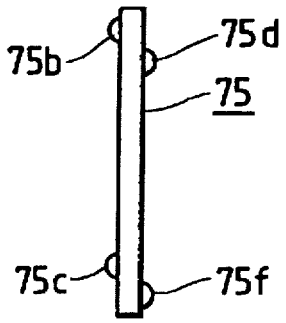

Embodiment 2:

FIGS. 5 to FIGS. 7(A)–7(*b*) show a second embodiment of the invention. FIG. 5 is a longitudinal sectional view showing the axial section of a change-over switch. FIG. 6 is a sectional view taken on line VI—VI in FIG. 5. FIGS. 7(A)–7(*b*) are drawings details of a moving contact. In the figures, a moving contact 75 of a moving contact assembly 71 is made of a copper alloy like a rectangle and is fitted to a moving shaft member 32 as the moving contact 35 in Embodiment 1 in FIG. 1 to the step of the insulation bush 33.

As shown in FIGS. 7(A)–7(*b*), three protrusions 75*a* to 75*c* are stamped so as to make an isosceles triangle on one face of the moving contact 75 and come in contact with a normally closed fixed contact part 93*a* and a normally closed common fixed contact part 104*b*. Likewise, three protrusions 75*d* to 75*f* are stamped on the opposed face of the moving contact 75 and come in contact with a normally open fixed contact part 103*a* and a normally open common fixed contact part 104*d*. Other parts of the moving contact assembly 71 are identical with or similar to those previously described with reference to FIG. 1 and are denoted by the same reference numerals in FIG. 5 and will not be discussed again.

A contact mold 91 and a cap switch 101 comprise a fixed contact assembly 81. A normally closed fixed contact 93 includes a contact part 93*a*. A normally open fixed contact 103 includes a contact part 103*a*. A common fixed contact 104 includes a recessed groove 104*a*, a normally closed common fixed contact part 104*b*, and normally open common fixed contact part. These components of the change-over switch of the second embodiment are also identical with or similar to the contact mold 51 and the cap switch 61 comprising the fixed contact assembly 41, the normally closed fixed contact 53, the contact part 53*a*, normally open fixed contact 63, the contact part 63*a*, the common fixed contact 64, the recessed groove 64*a*, the normally closed common fixed contact part 64*b*, and the normally open common fixed contact part 64*d* described in connection with the first embodiment of the invention depicted in FIG. 1.

However, since the moving contact 75 is formed with the protrusions 75*a* to 75*f*, the corresponding protrusions 53*b*, 63*b*, 64*c*, and 64*e* of the contacts provided in the embodiment of the invention depicted in FIG. 1 are not provided in the second embodiment of the invention. A housing part 105 is defined by the cap switch 101, the contact mold 91, and a fixed core 24 and is made substantially airtight.

Other parts are identical with or similar to those shown in FIG. 1.

In this case, the moving contact 75 is formed like a plate as shown in FIGS. 5–7. The second embodiment of the invention can be assembled in the manner described below. The contact mold 91 is placed above an electro-magnetic coil device 22 having its fixed core 24 facing upwards. Next, a left shaft part 32*b* of a moving shaft member of the moving contact assembly 71 is inserted into a through hole 24*c* of the fixed core. At the same time, the moving contact 75 is placed so that its longest side becomes vertical, as shown FIG. 6.

Next, the contact mold 91 is turned 90 degrees counter-clockwise from the condition indicated by the solid line in FIG. 6 to the condition indicated by the alternate long and short dash line and is made to abut the fixed core 24, then is restored 90 degrees clockwise to the former condition indicated by the solid line, whereby the lower end of the moving contact 75 in the figure is positioned within the recessed groove 104*a* of the common fixed contact.

After this, as in the embodiment in FIG. 1, packing (not shown) is inserted between the fixed core 24 and the contact mold 91 and between the contact mold 91 and the cap switch 101, and the contact mold 91 and the cap switch 101 are fixed integrally to the electro-magnetic coil device 22 with a through bolt (not shown). Thus, the cap switch 101, the contact mold 91, and the fixed core 24 define the housing part 105 in substantial gas-sealing relation.

Thus, the moving contact 75 is formed to allow the normally open common fixed contact part 104*d* to elude the moving contact 75, thereby allowing the moving contact 75 to axially pass by the normally open common fixed contact part 104*d* to a location where the moving contact 75 can be positioned within the recessed groove 104*d* of the common fixed contact 104. This eliminates the need for previously combining the moving contact assembly 71 and the cap switch 101 as in the embodiment in FIG. 1 before attachment to the fixed core. Therefore, these components of the moving contact assembly 71 can be assembled from the axial direction, namely, from one direction so that their assembly is highly flexible, the work time can be reduced, and the automation of assembly is also facilitated.

Since three protrusions 75*a* to 75*c* are disposed on one face of the moving contact 75 and three protrusions 75*d* to 75*f* on the opposed face like a triangle, each set of the three protrusions can come in stable contact with the fixed contact for improving contact reliability.

When the moving shaft member 32 is driven right by the moving core 26, the moving contact 75 comes in contact with the normally open fixed contact part 103*a* and the normally open common fixed contact part 104*d*, shorting between both the contacts. When the excitation coil is not energized, the moving contact 75 comes in contact with the normally closed fixed contact part 93*a* and the normally closed common fixed contact part 104*b*, shorting between both the contacts.

Figure 8:
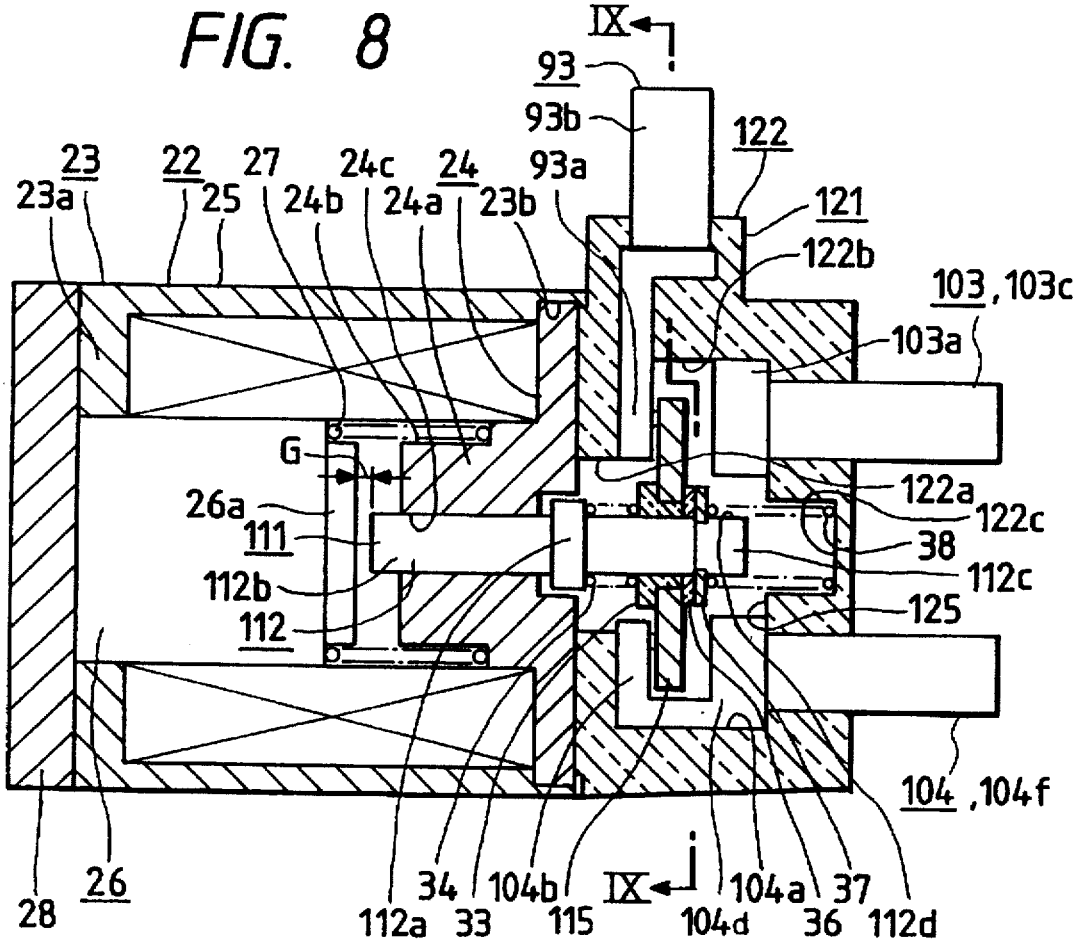
FIG. 8 is a longitudinal sectional view showing the axial section of a change-over switch according to a still another embodiment of the invention.
Figure 9:
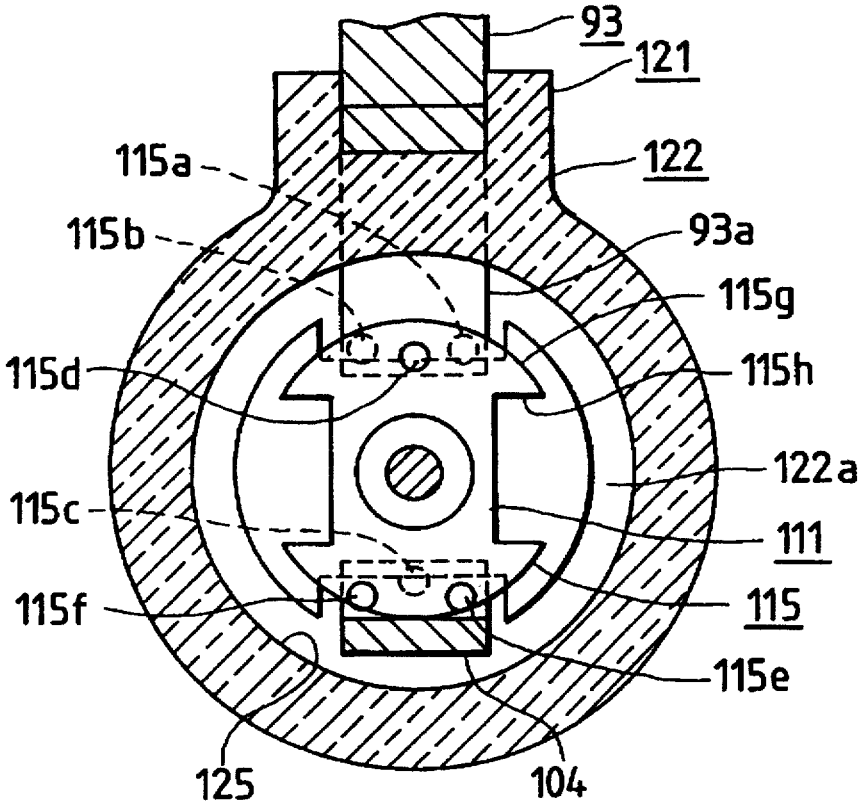
FIG. 9 is a sectional view taken on line IX—IX in FIG. 8.

Embodiment 3:

FIGS. 8 and 9 show a third embodiment of the invention. FIG. 8 is a longitudinal sectional view showing the axial section of a change-over switch. FIG. 9 is a sectional view taken on line IX—IX in FIG. 8.

In the figures, a moving contact assembly 111 has the following structure: A moving shaft member 112 comprises a flange part 112*a* having a circular section, a left shaft part 112*b* having a square section, and a right shaft part 112*c* having a circular section, provided by machining steel material.

The right shaft part 112*c* is formed with a recessed groove 112*d* like an annular ring and the left shaft part 112*b* having the square section is inserted into a through hole 24*c* (in this case, formed as a square matching the left shaft part 112*b*) of a fixed core so as to be axially slidable. An insulation bush 33 is loosely fitted to the right shaft part 112*c* of the moving shaft member so that it is axially slidable. A contact pressure spring 34 is inserted between the flange part 112*c* of the moving shaft member and the insulation bush 33 in a compressed condition.

A moving contact 115, which comprises two notches 115*h* provided on a disk part 115*g* as shown in FIG. 9, is made of a copper alloy and is fitted to the step of the insulation bush 33. As shown in FIG. 9, three protrusions 115*a* to 115*c* are stamped so as to make an isosceles triangle on one face of the moving contact 115 and come in contact with a normally closed fixed contact part 93*a* and a normally closed common fixed contact part 104*b*. Likewise, three protrusions 115*d* to 115*f* are stamped on the opposed face of the moving contact 115 and come in contact with a normally open fixed contact part 103*a* and a normally open common fixed contact part 104*d*. Other parts of the moving contact assembly 111 are identical with or similar to those previously described with reference to FIG. 1 and are denoted by the same reference numerals in FIG. 8 and will not be discussed again.

An insulation disk 36 is inserted into the right shaft part 112*c* so as to put the moving contact between it and the insulation bush 34 axially.

A fixed contact assembly 121 has the following structure: An integral support member 122, which is a common support member, is formed by inserting and molding by the normally closed fixed contact 93, the normally open fixed contact 103, the common fixed contact 104, and insulation mold material (not shown). The relative position relationships among the normally closed fixed contact 93, the normally open fixed contact 103, and the common fixed contact 104 are as shown in FIG. 1.

The integral support member 122 is formed with a somewhat large hole 122*a* (see FIG. 9) similar to the moving contact 115. In order for the moving contact 115 to pass by the normally open common fixed contact 104*d* when the fixed contact assembly 121 is mounted on the fixed core 24 and to simplify the construction of the mold structure when the integral support member 112 is formed, a core mold is divided and taken out. For this purpose, the hole 122*a* is provided. Further, the integral support member 122 is formed with a circular space part 122*b* and a recess 122*c* for housing a moving shaft member return spring 38 at the center.

The fixed contact assembly 121 is fixed to the fixed core 24 via packing (not shown), whereby a housing part 125 is made substantially airtight as in the embodiment in FIG. 1 for housing the moving contact 115.

The change-over switch thus structured is assembled in the manner described below. The fixed core 24 of the electro-magnetic coil device 22 placed with the fixed core 24 upward is formed with a square hole 24*c* depicted in place of the through hole 24*c* in FIG. 1, and a square shaft part 112*b* of the moving shaft member 112 of the moving contact assembly 111 is inserted so that the notch 115*h* of the moving contact 115 is positioned as shown in FIG. 9.

Next, packing (not shown) is inserted between the fixed contact assembly 121 and the fixed core 24. Subsequently, the fixed contact assembly 121 is turned 90 degrees clockwise from the condition shown in FIG. 9. In this state, the moving contact 115 enters the hole 122*a* and passes by the normally open common fixed contact part 104*d* Then, the fixed contact assembly is restored 90 degrees counterclockwise to the condition shown in FIG. 9. After this, the fixed contact assembly 121 is fixed to the fixed core 24 with a locking bolt (not shown).

In the above described Embodiments, the normally closed fixed contact (element 53 in FIG. 1, element 93 in FIGS. 5 and 8) and the normally closed common fixed contact part (element 64*b* in FIG. 1, element 104*b* in FIGS. 5 and 8) of the common fixed contact (element 64 of FIG. 1 and element 104 in FIGS. 5 and 8) inserted and molded to the cap (element 62 in FIGS. 1 and 5) make up a first set of fixed ;contacts and the normally open fixed contact (element 63 in FIGS. 1 and 5) and the normally closed common fixed contact part (element 64*d* of FIG. 1 and element 104*d* of FIGS. 5 and 8) make up a second set of fixed contacts, but three or four fixed contacts may make up a set as required.

Although the common fixed contact (element 64 of FIG. 1) is formed by working a part of a copper alloy block into the recessed groove 64*a*, the two members may be integrally formed by brazing, etc.

Further, the normally closed fixed contact part (element 64*b* of FIG. 1) is integrated with the normally open fixed contact part (element 64*d* of FIG. 1) into the common fixed contact (element 64 of FIG. 1), but the normally closed fixed contact part (element 64*b* FIG. 1) may be separated as the normally closed fixed contact (element 53 of FIG. 1), and be molded integrally with the first mold member (element 52 of FIG. 1) with an insulation resin.

The contacts and the protrusions are plated with silver as required, thereby preventing an oxide film from being formed and lessening a temperature rise even if the energization time is long. If the contacts are used together with the protrusions, contact stability can be furthermore provided. The protrusions may be disposed on the fixed contacts or the moving contacts as required.

Normally, such a change-over switch is switched in a non-energization state, but arc-proof contact material can also be used for the contacts so that the change-over switch can be switched in an energization state.

Further, the first and second mold members are inserted and molded with the fixed contacts, but the fixed contacts may be attached to insulation material and the housing part need not necessarily be airtight and may be made airtight as required.

Thus, the change-over switch according to an exemplary embodiment the invention comprises an electro-magnetic coil device having a fixed core, an excitation coil, and a moving core axially driven by energy of the excitation coil, a moving contact assembly having a moving shaft member axially driven by the moving core and a moving contact fitted to the moving shaft member, and a fixed contact assembly having a support member for supporting a first set of fixed contacts and a second set of fixed contacts spaced from the first fixed contact set at a predetermined distance in a direction in which the moving shaft member is driven, the fixed contact assembly being fixed to the electro-magnetic coil device so that when the excitation coil is not energized, the moving contact is pressed into contact with the first fixed contact set and when the excitation coil is energized, the moving contact is pressed into contact with the second fixed contact set, wherein the moving contact assembly is supported by the electro-magnetic coil device so that it is detachable from the fixed contact side and driven when the moving shaft member abuts the moving core. Therefore, assembly is facilitated and the manufacturing costs also become low.

According to the change-over switch according to an exemplary embodiment of the invention, the fixed contact assembly comprises a first fixed contact assembly having a first support member for supporting the first fixed contacts and a second fixed contact assembly having a second support member for supporting the second fixed contacts, the second fixed contact assembly being able to be separated axially from the first fixed contact assembly. Therefore, assembly is furthermore facilitated and the manufacturing costs also become low.

According to the change-over switch according to an exemplary embodiment of the invention, the first support member is a first hollow insulation support member integrally molded with the first fixed contacts with insulation material and the second support member is a second insulation support member integrally molded with the second fixed contacts with insulation material, the second insulation support member is fixed to the electro-magnetic coil device with the first insulation support member between, and the moving contact is housed in a substantially airtight housing part defined by the second insulation support member, the first insulation support member, and the electro-magnetic coil device. Therefore, the moving contact is protected, assembly is facilitated, and the manufacturing costs become low.

According to the change-over switch according to one exemplary embodiment of the invention, the fixed contact assembly comprises a first fixed contact assembly having a first support member for supporting at least one of the first fixed contacts, a second fixed contact assembly having a second support member for supporting at least one of the second fixed contacts, the second fixed contact assembly being able to be separated axially from the first fixed contact assembly, and a common fixed contact having a groove recessed from the diametric inside toward the outside with one of the first fixed contacts and one of the second fixed contacts molded in one piece, the common fixed contact being supported by the first or second support member, the moving contact being positioned within the recessed groove allowing one of the first fixed contacts to elude the moving contact and axially pass through. Therefore, the number of parts is reduced, assembly is facilitated and the manufacturing costs also become low.

According to the change-over switch according to one exemplary embodiment of the invention, the first support member is a first insulation support member integrally molded with at least one of the first fixed contacts and common fixed contact with insulation material and the second support member is a second insulation support member integrally molded with at least one of the second fixed contacts and common fixed contact with insulation material, the second insulation support member is fixed to the electro-magnetic coil device with the first insulation support member between, and the moving contact is housed in a substantially airtight housing part defined by the second insulation support member, the first insulation support member, and the electro-magnetic coil device. Therefore, the moving contact is protected, the number of parts is reduced, assembly is facilitated, and the manufacturing costs become low.

According to the change-over switch according to one exemplary embodiment of the invention, the moving contact is formed like a disk and is positioned within the recessed groove. Therefore, the disk-like moving contact eliminates the need for strict alignment of moving and fixed contacts, thus assembly is also easy to made and the manufacturing costs also become low.

According to the change-over switch according to one exemplary embodiment of the invention, the moving contact is formed to allow one of the first fixed contacts to elude the moving contact and axially pass through. Thus, if one of the first fixed contacts and one of the second fixed contacts are made a common fixed contact, assembly can be made from the axial direction, namely, from one direction; the assembly is highly flexible and the work time can also be reduced. The common fixed contact enables the number of parts to be reduced and can be easily supported by the support member. Therefore, an inexpensive change-over switch can be provided.

According to the change-over switch according to one exemplary embodiment of the invention, the fixed contact assembly has a common support member for supporting the first and second fixed contacts, the moving contact is formed to allow the first fixed contacts to elude the moving contact and axially pass through, and the common support member is fixed to the electro-magnetic coil device so that the moving contact is positioned between the first and second fixed contacts allowing the first fixed contacts to elude the moving contact and axially pass through. Therefore, the number of parts can further be reduced, assembly is facilitated, and the manufacturing costs become low.

According to the change-over switch according to one exemplary embodiment of the invention, the common support member is a hollow integral support member integrally molded with the first and second fixed contacts with insulation material, the integral support member is fixed to the electro-magnetic coil device so that the moving contact is positioned between the first and second fixed contacts allowing the first fixed contacts to elude the moving contact and axially pass through, and the moving contact is housed in a substantially airtight housing part defined by the integral support member and the electro-magnetic coil device. Therefore, the moving contact is protected, assembly is facilitated, and the manufacturing costs become low.

According to the change-over switch according to one exemplary embodiment of the invention, the fixed contact assembly comprises a common fixed contact having a groove recessed from the diametric inside toward the outside with one of the first fixed contacts and one of the second fixed contacts molded in one piece, the moving contact being positioned within the recessed groove allowing one of the first fixed contacts to elude the moving contact and axially pass through. Therefore, the number of parts can be further reduced and the manufacturing costs also become low.

According to the change-over switch according to one exemplary embodiment of the invention, the moving shaft member is supported by the electro-magnetic coil device so that it does not rotate. Therefore, assembly is also facilitated and the manufacturing costs also become low. Also, there is no chance that the moving shaft member, which is rotated due to vibration in operation, etc., will make an insufficient area in which the moving contact comes in contact with the first or second moving contact or that they will be placed out of contact with each other; reliability is improved.

What is claimed is:

1. A change-over switch comprising:

an electro-magnetic coil device including a fixed core, an excitation coil, and a moving core axially driven by energy of said excitation coil;

a moving contact assembly including a moving shaft member axially driven by said moving core, and a moving contact fitted to said moving shaft member, and a fixed contact assembly including a pair of first fixed contacts, a pair of second fixed contacts spaced from the first fixed contacts by predetermined distance in a direction of driving of said moving shaft member, and a primary support member for supporting said first pair of fixed contacts and said second pair of fixed contacts, said fixed contact assembly being fixed to said electro-magnetic coil device so that when said excitation coil is energized, said moving contact is moved from said first pair of contacts and pressed into contact with said second pair of fixed contacts, said moving contact being moved from said second pair of contacts and pressed into contact with said first pair fixed contacts when said excitation coil is not energized, wherein said moving contact assembly is supported by said electro-magnetic coil device so that it is detachable from the fixed contact assembly, and wherein a predetermined gap exists between said moving core and said moving shaft when said moving contact is pressed into contact with said first pair of fixed contacts and said moving core is driven in a manner so that said moving core abuts said moving shaft member when said moving contact is being moved from said first pair of contacts towards said second pair of contacts.

2. The change-over switch as claimed in claim 1, wherein said moving contact is formed to allow one contact of said second pair of fixed contacts to elude said moving contact, thereby allowing said moving contact to axially pass by the one contact of said second pair of fixed contacts to a location where the moving contact can be positioned between the one contact of said second pair of fixed contacts and one contact of said first pair of fixed contacts; and wherein said primary support member is fixed to said electro-magnetic coil device.

3. The change-over switch as claimed in claim 1 wherein said moving shaft member is supported by said electro-magnetic coil device so that said moving shaft member does not rotate.

4. A change over switch comprising:

an electro-magnetic coil device including a fixed core, an excitation coil, and a moving core axially driven by energy of said excitation coil;

a moving contact assembly including a moving shaft member axially driven by said moving core, and a moving contact fitted to said moving shaft member, and a fixed contact assembly including a first fixed contact assembly having a first support member for supporting a first pair of fixed contacts, and a second fixed contact assembly having a second support member for supporting a second pair of fixed contacts, said second fixed contact assembly being able to be separated axially from said first fixed contact assembly, said pair of second fixed contacts being spaced from the first fixed contacts by a predetermined distance in a direction of driving of said moving shaft member, said fixed contact assembly being fixed to said electro-magnetic coil device so that when said excitation coil is energized said moving contact is moved from said first pair of contacts and pressed into contact with said second pair of fixed contacts, said moving contact being moved from said second pair of contacts and pressed into contact with said first pair of fixed contacts when said excitation coil is not energized, wherein said moving contact assembly is supported by said electro-magnetic coil device so that it is detachable from the fixed contact assembly, and wherein said moving core is driven in a manner so that said moving core abuts said moving shaft member when said moving contact is being moved from said first pair of contacts towards said second pair of contacts.

5. The change-over switch as claimed in claim 4, wherein said first support member is a first hollow insulation support member integrally molded with said first fixed contacts with insulation material, and said second support member is a second insulation support member integrally molded with said second fixed contacts with insulation material, and wherein said second insulation support member is fixed to said electro-magnetic coil device with said first insulation support member between, and wherein said moving contact is housed in a substantially airtight housing part defined by said second insulation support member, said first insulation support member, and said electro-magnetic coil device.

6. A change over switch comprising:

an electro-magnetic coil device including a fixed core, an excitation coil, and a moving core axially driven by energy of said excitation coil;

a moving contact assembly including a moving shaft member axially driven by said moving core, and a moving contact fitted to said moving shaft member, and a fixed contact assembly including a first fixed contact assembly having a first support member for supporting one contact of a first pair of fixed contacts, a second fixed contact assembly having a second support member for supporting one contact of a second pair of fixed contacts, said second fixed contact assembly being axially separable from said first fixed contact assembly, and a common fixed contact having a groove recessed from a diametric inside of said common fixed contact towards an outside of said common fixed contact, said common fixed contact comprising the other contact of said first pair of fixed contacts and the other contact of said second pair of fixed contacts which are molded in one piece, said common fixed contact being supported by said first or second support member, said moving contact being positioned within said recessed groove, said pair of second fixed contacts being spaced from the first fixed contacts by a predetermined distance in a direction of driving of said moving shaft member, said fixed contact assembly being fixed to said electro-magnetic coil device so that when said excitation coil is energized said moving contact is moved from said first pair of contacts and pressed into contact with said second pair of fixed contacts, said moving contact being moved from said second pair of contacts and pressed into contact with said first pair of fixed contacts when said excitation coil is not energized, wherein said moving contact assembly is supported by said electro-magnetic coil device so that it is detachable from the fixed contact assembly, and wherein said moving core is driven in a manner so that said moving core abuts said moving shaft member when said moving contact is being moved from said first pair of contacts towards said second pair of contacts.

7. The change-over switch as claimed in claim 6, wherein said first support member is a first insulation support member integrally molded with the one contact of said first pair of fixed contacts and said common fixed contact using insulation material, and said second support member is a second insulation support member integrally molded with the one contact of said second pair of fixed contacts and said common fixed contact using insulation material, and wherein said second insulation support member is fixed to said electro-magnetic coil device with said first insulation support member being between said second insulation support member and said electro-magnetic coil device, and wherein said moving contact is housed in a substantially airtight housing part defined by said second insulation support member, said first insulation support member, and said electro-magnetic coil device.

8. The change-over switch as claimed in claim 6, wherein said moving contact is formed like a disk and is positioned within said recessed groove.

9. The change-over switch as claimed in claim 6, wherein said moving contact is formed to allow the other contact of said second pair of fixed contacts included in said common fixed contact to elude said moving contact, thereby allowing said moving contact to axially pass by the other contact of said second pair of fixed contacts to a location where the moving contact can be positioned within said recessed groove of said common fixed contact.

10. A change over switch comprising:

an electro-magnetic coil device including a fixed core, an excitation coil, and a moving core axially driven by energy of said excitation coil;

a moving contact assembly including a moving shaft member axially driven by said moving core, and a moving contact fitted to said moving shaft member, and a fixed contact assembly including a pair of first fixed contacts, a pair of second fixed contacts spaced from the first fixed contacts by predetermined distance in a direction of driving of said moving shaft member, and a primary support member for supporting said first pair of fixed contacts and said second pair of fixed contacts, said fixed contact assembly being fixed to said electro-magnetic coil device so that when said excitation coil is energized, said moving contact is moved from said first pair of contacts and pressed into contact with said second pair of fixed contacts, said moving contact being moved from said second pair of contacts and pressed into contact with said first pair of fixed contacts when said excitation coil is not energized, wherein said moving contact assembly is supported by said electro-magnetic coil device so that it is detachable from the fixed contact assembly, wherein said moving core is driven in a manner so that said moving core abuts said moving shaft member when said moving contact is being moved from said first pair of contacts towards said second pair of contacts, wherein said moving contact is formed to allow one contact of said second pair of fixed contacts to elude said moving contact, thereby allowing said moving contact to axially pass by the one contact of said second pair of fixed contacts to a location where the moving contact can be positioned between the one contact of said second pair of fixed contacts and one contact of said first pair of fixed contacts;

wherein said primary support member is fixed to said electro-magnetic coil device;

wherein said primary support member is a hollow integral support member integrally molded with said first and second fixed contacts with insulation material; and wherein said moving contact is housed in a substantially airtight housing part defined by said integral support member and said electro-magnetic coil device.

11. The change-over switch as claimed in claim 10, wherein said fixed contact assembly comprises a common fixed contact having a groove recessed from a diametric inside of said common fixed contact towards an outside of said common fixed contact, said common fixed contact including one contact of said first pair of fixed contacts and the one contact of said second pair of fixed contacts and being molded in one piece.

12. A change over switch comprising:

an electro-magnetic coil device including a fixed core, an excitation coil, and a moving core axially driven by energy of said excitation coil;

a moving contact assembly including a moving shaft member axially driven by said moving core, and a moving contact fitted to said moving shaft member, and a fixed contact assembly including a pair of first fixed contacts, a pair of second fixed contacts spaced from the first fixed contacts by predetermined distance in a direction of driving of said moving shaft member, and a primary support member for supporting said first pair of fixed contacts and said second pair of fixed contacts, said fixed contact assembly being fixed to said electro-magnetic coil device so that when said excitation coil is energized, said moving contact is moved from said first pair of contacts and pressed into contact with said second pair of fixed contacts, said moving contact being moved from said second pair of contacts and pressed into contact with said first pair of fixed contacts when said excitation coil is not energized, wherein said moving contact assembly is supported by said electro-magnetic coil device so that it is detachable from the fixed contact assembly;

wherein said moving core is driven in a manner so that said moving core abuts said moving shaft member when said moving contact is being moved from said first pair of contacts towards said second pair of contacts;

wherein said moving contact is formed to allow one contact of said second pair of fixed contacts to elude said moving contact, thereby allowing said moving contact to axially pass by the one contact of said second pair of fixed contacts to a location where the moving contact can be positioned between the one contact of said second pair of fixed contacts and one contact of said first pair of fixed contacts;

wherein said primary support member is fixed to said electro-magnetic coil device; and wherein said fixed contact assembly comprises a common fixed contact having a groove recessed from a diametric inside of said common fixed contact towards an outside of said common fixed contact, said common fixed contact including one of said first pair of fixed contacts and the one of said second pair of fixed contacts and being molded in one piece.

* * * * *